US010898758B2

(12) United States Patent
Bengtsson et al.

(10) Patent No.: US 10,898,758 B2
(45) Date of Patent: Jan. 26, 2021

(54) MEASUREMENT SYSTEM FOR USE IN AN EXERCISE MACHINE

(71) Applicant: SONY MOBILE COMMUNICATIONS INC., Tokyo (JP)

(72) Inventors: Henrik Bengtsson, Lund (SE); Anders Linge, Kävlinge (SE); Johan Nyman, Lund (SE); Christer Fletcher, Dösjebro (SE); Magnus Landqvist, Södra Sandby (SE)

(73) Assignee: Sony Corporation, Tokyo (JP)

( * ) Notice: Subject to any disclaimer, the term of this patent is extended or adjusted under 35 U.S.C. 154(b) by 72 days.

(21) Appl. No.: 16/092,788

(22) PCT Filed: Apr. 13, 2016

(86) PCT No.: PCT/EP2016/058146
§ 371 (c)(1),
(2) Date: Oct. 11, 2018

(87) PCT Pub. No.: WO2017/178048
PCT Pub. Date: Oct. 19, 2017

(65) Prior Publication Data

US 2019/0160335 A1 May 30, 2019

(51) Int. Cl.
*A63B 24/00* (2006.01)
*A63B 21/062* (2006.01)
*A63B 71/06* (2006.01)

(52) U.S. Cl.
CPC ..... *A63B 24/0062* (2013.01); *A63B 21/063* (2015.10); *A63B 21/0628* (2015.10);
(Continued)

(58) Field of Classification Search
CPC ..... A63B 24/0062; A63B 21/0628; A63B 21/063; A63B 24/0087; A63B 2220/17;
(Continued)

(56) References Cited

U.S. PATENT DOCUMENTS 5,474,083 A * 12/1995 Church ..... A61B 5/0488 600/546
5,785,632 A * 7/1998 Greenberg ..... A63B 21/0628 482/1
(Continued)

FOREIGN PATENT DOCUMENTS

CN 203183566 U 9/2013
CN 103830898 A 6/2014
(Continued)

OTHER PUBLICATIONS

Japanese Notice of Reasons for Refusal for corresponding Japanese Patent Application No. 2018-553878 dated Sep. 30, 2019.
(Continued)

*Primary Examiner* — Garrett K Atkinson
(74) *Attorney, Agent, or Firm* — Renner, Otto, Boisselle & Sklar, LLP

(57) ABSTRACT

A measurement system for use in an exercise machine, which exercise machine comprises a lifting mechanism and an engaging member for selectively engaging a number of stacked weights to the lifting mechanism, the measurement system comprising a pair of cooperating members including a range meter and a reflector member, wherein one of the cooperating members is connected to the lifting mechanism and the other of the cooperating members is connected to the engaging member, wherein the range meter is directed to measure a distance to the reflector member to determine a distance which correlates to the weight of the selectively engaged weights.

15 Claims, 4 Drawing Sheets

(52) U.S. Cl.
CPC ..... *A63B 24/0087* (2013.01); *A63B 21/0632* (2015.10); *A63B 2071/065* (2013.01); *A63B 2220/13* (2013.01); *A63B 2220/17* (2013.01); *A63B 2220/40* (2013.01); *A63B 2220/803* (2013.01); *A63B 2220/805* (2013.01); *A63B 2220/833* (2013.01); *A63B 2225/50* (2013.01)

(58) Field of Classification Search
CPC ..... A63B 2071/065; A63B 2225/50; A63B 2220/805; A63B 2220/803; A63B 2220/40; A63B 21/0632; A63B 2220/833; A63B 2220/13
See application file for complete search history.

(56) References Cited

U.S. PATENT DOCUMENTS

| | | | | |
|---|---|---|---|---|
| 6,013,007 | A * | 1/2000 | Root | A63B 24/0006 482/8 |
| 6,347,290 | B1 * | 2/2002 | Bartlett | G06F 1/1626 702/150 |
| 9,308,417 | B2 * | 4/2016 | Grundy | A63B 24/0062 |
| 9,950,236 | B1 * | 4/2018 | Jooste | A63B 71/06 |
| 9,987,188 | B1 * | 6/2018 | Diao | A61H 3/008 |
| 10,213,648 | B2 * | 2/2019 | Ishii | A63B 24/0087 |
| 10,300,335 | B2 | 5/2019 | Case, Jr. | |
| 10,315,072 | B2 * | 6/2019 | Skulman | A63B 24/0075 |
| 10,456,318 | B2 * | 10/2019 | Kuchenbecker | A61F 5/0102 |
| 2001/0011025 | A1 * | 8/2001 | Ohki | H04B 1/086 455/556.1 |
| 2003/0032529 | A1 * | 2/2003 | Alessandri | A63B 24/00 482/94 |
| 2003/0060344 | A1 * | 3/2003 | David | A63B 21/063 482/98 |
| 2004/0263473 | A1 * | 12/2004 | Cho | G06F 3/014 345/156 |
| 2005/0272561 | A1 * | 12/2005 | Cammerata | A63B 71/0622 482/8 |
| 2006/0234842 | A1 * | 10/2006 | Minami | A63B 21/0628 482/99 |
| 2007/0072748 | A1 | 3/2007 | Lee | |
| 2007/0213183 | A1 * | 9/2007 | Menektchiev | A63B 24/00 482/94 |
| 2008/0242509 | A1 * | 10/2008 | Menektchiev | A63B 21/0552 482/4 |
| 2010/0216603 | A1 * | 8/2010 | Somers | A63B 21/0628 482/8 |
| 2011/0287896 | A1 * | 11/2011 | Kim | A63B 21/065 482/8 |
| 2012/0135842 | A1 * | 5/2012 | Verkaik | A63B 21/068 482/5 |
| 2012/0220429 | A1 | 8/2012 | Yoshida et al. | |
| 2014/0330186 | A1 * | 11/2014 | Hyde | A61F 5/02 602/19 |
| 2016/0346617 | A1 * | 12/2016 | Srugo | G16H 40/40 |

FOREIGN PATENT DOCUMENTS

| | | | |
|---|---|---|---|
| EP | 1013312 | A2 | 6/2000 |
| FR | 2731627 | A1 | 9/1996 |
| JP | 2007-514495 | A | 6/2007 |
| JP | 2010-115472 | A | 5/2010 |
| JP | 2012-170754 | A | 9/2012 |
| JP | 2016-41253 | A | 3/2016 |
| WO | WO 99/43393 | A1 | 9/1999 |

OTHER PUBLICATIONS

International Search Report dated Feb. 10, 2017, issued in corresponding International Application No. PCT/EP2016/058146.
English translation of Search Report for Chinese Application No. 201680084551.8.
Japanese Decision of Rejection and translation for corresponding Japanese Patent Application No. 2018-553878 dated May 12, 2020.

* cited by examiner

MEASUREMENT SYSTEM FOR USE IN AN EXERCISE MACHINE

RELATED APPLICATIONS

This application is a national phase entry of International Application No. PCT/EP2016/058146 filed on Apr. 13, 2016 and published in the English language, which is hereby incorporated by reference.

TECHNICAL FIELD OF THE INVENTION

The invention relates generally to devices, systems and methods for measuring, transmitting, recording and displaying information relating to physical exercise and, more particularly, to a measurement system for use in an exercise machine comprising a lifting mechanism for selectively engaging a number of weights.

BACKGROUND

In recent years, there has been a virtual explosion in the popularity of exercise and physical fitness. There are many popular forms of physical exercise including, for example, running, bicycling, and weight training. The growing interest in weight training is reflected by the growing number of gyms found in both public and private settings.

There are various types of weight training equipment. Typical weight machines, for example, use gravity as the primary source of resistance. A combination of simple machines (e.g., pulleys, levers, wheels, inclines, etc.) to change the mechanical advantage of the overall machine relative to the weight and convey the resistance to the person using the machine. Conventional stacked weight machines, such as those made by Cybex International, Inc. and Nautilus, Inc., typically include a stack of rectangular weight plates through which a lifting mechanism, e.g. comprising a vertical lifting bar, passes. The lifting bar includes a plurality of holes configured to accept an engaging member, such as a pin. Each of the plates has a corresponding channel that aligns with one of the holes in the lifting bar when the lifting bar is in the lowered or at-rest position. To lift a selected number of the plates, the user operates the engaging member, e.g. by inserting a pin through the channel and the corresponding hole in the lift bar at a selected weight level. As the user goes through the exercise motion, the lift bar rises and the engaging member supports all of the plates stacked above it. The various settings on the weight machine allow the user to select from several different levels of resistance over the same range of motion by simply inserting the pin into the lift bar at a desired weight level.

Conventional weight pins usually include a cylindrical shaft made of stainless steel or other hard metal. In its simplest form, a weight pin can be made from a single piece of cylindrical metal rod that is bent slightly at one end to form a handle for inserting and removing the pin into a weight stack. Other types of weight pins can include a plastic or metal handle portion that is attached to the cylindrical shaft which is inserted into the weight stack. The shaft can include spring-loaded ball bearings and/or other locking features to releasably engage the pin with the weight stack and prevent it from becoming dislodged during use of the weight machine. Some pins with locking features include a push button on the handle to facilitate engagement of the locking feature with the weight stack and/or lifting bar.

One important aspect of any type of exercise program is the ability to track personal performance and progress. For example, people engaged in endurance or distance forms of exercise (e.g., running, swimming, bicycling, etc.) often track the distance and/or time associated with a particular run, swim, ride, etc. Similarly, people using cardiovascular exercise machines (e.g., treadmills, stair-steppers, stationary bicycles, etc.) are often interested in knowing how long they exercise or how many calories they burn during a particular session.

One shortcoming of conventional weight machines, however, is that they lack a convenient way for the user to track and record his or her progress on a particular machine or group of machines during a particular exercise session or over a given period of time. As a result, people engaged in weight training programs often rely on memory to keep track of how many weights they lifted on a particular occasion, or how many repetitions they performed on a particular machine. Rather than rely on memory, some people use notebooks to manually record information about their workout. Neither of these approaches, however, is particularly convenient.

In this context, a system for tracking workout related information was suggested in WO2015/113162A1. That system includes a wearable device wirelessly connectable to receive workout information related to use of a workout equipment, including a weight being used in the workout equipment. Workout information is collected by means of a weight stack selector device, which may determine both selected weight information and repetition information based on distance measured from a weight stack selector device to a stationary reference point. This may be accomplished by means of a transmitter incorporated in the selector device.

A problem related to systems for measuring and tracking workout data is power consumption. In a gym, exercise machines are typically spread out on the floor throughout one or more rooms, and access to a mains outlet is rarely available at each machine. The system is therefore preferably battery-charged, and moderate power consumption is consequently an overall objective. Furthermore, even if an exercise machine is intended to be used in a certain manner, gym users tend to find new ways of exercising using such machines. The measurement system should be so devised that minimum user interaction is required, and such that accidental tampering or inhibition of the measurement is prevented during foreseeable use of the exercise machine.

SUMMARY

A measurement system for use in an exercise machine is proposed, which exercise machine comprises a lifting mechanism and an engaging member for selectively engaging a number of weights to the lifting mechanism.

According to a first aspect, a measurement system for use in an exercise machine is provided, which exercise machine comprises a lifting mechanism and an engaging member for selectively engaging a number of stacked weights to the lifting mechanism, the measurement system comprising a pair of cooperating members including a range meter and a reflector member, wherein one of the cooperating members is connected to the lifting mechanism and the other of the cooperating members is connected to the engaging member, wherein the range meter is directed to measure a distance to the reflector member to determine a distance which correlates to the weight of the selectively engaged weights.

In one embodiment, the range meter is connected to the lifting mechanism and the reflector member is connected to the engaging member.

In one embodiment the measurement system comprises an operation detection mechanism communicatively connected to trigger the range meter to make a distance measurement responsive to detection of operation of the exercise machine.

In one embodiment, the operation detection mechanism comprises a motion sensor connected to sense movement of the lifting mechanism.

In one embodiment, the motion sensor mechanism is wirelessly connected to the range meter.

In one embodiment, the motion sensor is connected to a member of the lifting mechanism so as to sense rotational movement about a non-vertical axis upon operation of the exercise machine.

In one embodiment, the operation detection mechanism comprises a motion sensor connected to the engaging member, configured to detect movement or placement of the engaging member with respect to the stack of weights for detecting operation of the exercise machine.

In one embodiment, the operation detection mechanism comprises a proximity sensor connected to the engaging member, configured to detect movement or placement of the engaging member with respect to the stack of weights for detecting operation of the exercise machine.

In one embodiment, the proximity sensor comprises a magnetometer for detecting that the engaging member is inserted in the weight stack.

In one embodiment, the operation detection mechanism is configured to trigger the optical range meter to make a single distance measurement for an exercise sequence comprising any number of lifting repetitions without alteration of weight.

In one embodiment the measurement system further comprises an auxiliary reflector member attached to a fixed position with respect to the gym machine, wherein the range meter is directed to measure a distance to the auxiliary reflector member to detect movement of the lifting mechanism.

In one embodiment, the measurement system comprises a control unit configured to establish exercise data by calculating a weight setting of the exercise machine based on the measured distance.

In one embodiment, the control unit configured to establish exercise data by calculating a number of repetitions carried out based on input from the motion sensor.

In one embodiment the measurement system comprises a display device connected to receive exercise data from the control unit and to present the exercise data to a user of the exercise machine.

In one embodiment, the control unit comprises a communication interface for wireless transmission of exercise data to a receiving node.

In one embodiment the measurement system comprises an auxiliary sensor to detect a position of a movable auxiliary selector member of the exercise machine, which auxiliary selector member is configured to engage an additional amount of weight to the lifting mechanism.

In one embodiment, the auxiliary sensor comprises a proximity sensor connected to sense proximity of detection element connected to the auxiliary selector member.

In one embodiment, the auxiliary selector member comprises a rotatable selector member and the auxiliary sensor includes a rotation sensor mechanism connected to detect angular position of the rotatable selector member.

In one embodiment, the rotation sensor includes an accelerometer.

In one embodiment, the range meter comprises a time of flight sensor.

In one embodiment, the range meter comprises an electromagnetic transmitter and receiver.

In one embodiment, the range meter comprises a radar.

In one embodiment, the range meter comprises an ultrasound transmitter and receiver.

In one embodiment, the time of flight sensor comprises a light emitter configured to emit a periodic signal, a light detector, and a measurement circuit configured to measure distance dependent on an emitted signal and a reflected signal received by the detector.

According to a second aspect, a measurement system for use in an exercise machine is provided, which exercise machine comprises a lifting mechanism and a rotatable selector member for selectively engaging a number of weights to the lifting mechanism, the measurement system comprising a rotation detector connected to the rotatable selector member, wherein the rotation detector is configured to determine angular position of the rotatable selector member which correlates to the weight of the selectively engaged weights.

In one embodiment, the rotation detector includes an accelerometer configured to sense rotation of the selector member with respect to the direction of gravity.

In one embodiment, the measurement system comprises a control unit configured to establish exercise data by calculating a weight setting of the exercise machine based on the detected rotation.

According to a third aspect, a measurement system for use in an exercise machine is provided, which exercise machine comprises a lifting mechanism and an engaging member for selectively engaging a number of stacked weights to the lifting mechanism, the measurement system comprising an operation detection mechanism including an accelerometer connected to a member of the lifting mechanism so as to sense rotational movement about a non-vertical axis upon operation of the exercise machine.

Details, function, effects and benefits of various embodiments are outlined in the detail description and the appended drawings.

BRIEF DESCRIPTION OF THE DRAWINGS

Various embodiments are described below with reference to the accompanying drawings.

DETAILED DESCRIPTION OF EMBODIMENTS

Figure 1:
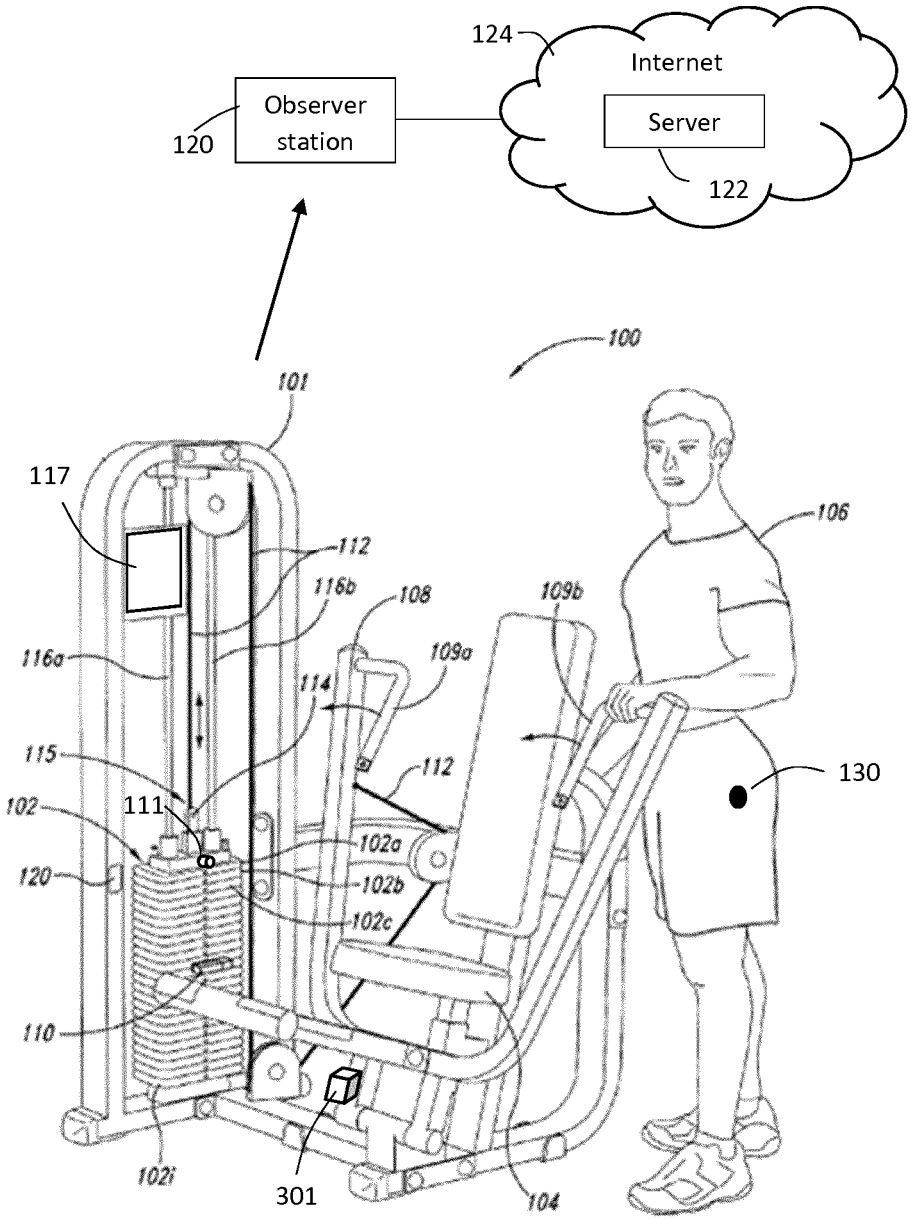
FIG. 1 is a view of an exemplary exercise machine implementing an embodiment of the proposed measurement system.

Embodiments will now be described with reference to the drawings, wherein like reference numerals are used to refer to like elements throughout. To facilitate the discussion of any particular element, the most significant digit or digits of any reference number refer to the Figure in which that element is first introduced. It will be understood that the figures are not necessarily to scale. Also, features that are described and/or illustrated with respect to one embodiment may be used in the same way or in a similar way in one or more other embodiments and/or in combination with or instead of the features of the other embodiments.

Certain details are set forth in the following description and in FIGS. 1-4 to provide a thorough understanding of various embodiments of the present disclosure. Other details describing well-known structures and systems often associated with weight training machines, signal processing systems, and electronic display devices, however, are not set forth in the following disclosure to avoid unnecessarily obscuring the description of various embodiments. Many of the details, dimensions, and other features shown in the figures are merely illustrative of particular embodiments of the disclosure.

Accordingly, other embodiments can have other details, dimensions, and features without departing from the scope of the present disclosure. In addition, further embodiments of the present disclosure can be practiced without several of the details described below.

FIG. 1 is an isometric view of an exercise system 100 configured in accordance with an embodiment of the present disclosure. The exercise system 100 includes a conventional stacked weight exercise machine 101 having a plurality of weights 102 (identified individually as weights 102*a*-102*i*), and a measurement system 111 for receiving, determining and/or recording information related to use of an exercise machine 101. A lifting mechanism of the exercise machine may include a weight support member 114, movably suspended from a cable 112 and hanging downward through the weight stack 102. The support member 114 includes a plurality of through-holes positioned adjacent to corresponding weights 102 when the support member 114 is in the relaxed or lowered position shown in FIG. 1. The cable 112 attaches the support member 114 to a movable exercise bar 108 via a system of pulleys. The amount of weight to lift in operation of the exercise machine is selectively set by means of an engaging member 110. In various embodiments, the engaging member includes a weight pin 110, configured to be inserted through a hole or slot in the desired weight 102. The user 106 pushes the weight pin 110 through the slot until it passes through the adjacent hole in the support member 114. The user 106 then sits on a seat 104 and grasps a right handle 109*a* and a left handle 109*b* on the exercise bar 108. As the user 106 presses the bar 108 forward it rotates, pulling on the cable 112 and drawing the support member 114 upwardly. As the support member 114 moves upwardly, 15 the weight pin 110 moves all of the weights 102 stacked above the weight pin 110 upwardly. Various types of exercise machines may comprise parallel guide members 116*a* and 116*b*, along which the lifted weights are configured to slide. When the user 106 relaxes his arms and allows his hands to move back toward his chest, the lifted weights 102 return downwardly to the stack. As will be readily understood by the skilled reader, the exercise machine of FIG. 1 is merely an example. Other types of exercise machines may be configured to be operated by a standing or lying user, and may be designed such that the lifting mechanism is operated by a pushing, pulling or rotating motion carried out by the user.

Various embodiments of a measurement system for use in an exercise machine will now be described with reference to the drawings.

Figure 2A:
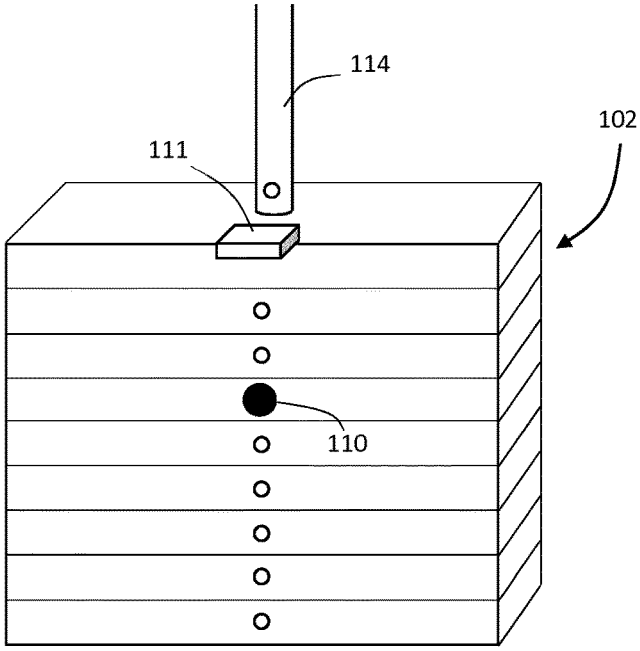
FIG. 2 is a view of a part of an exercise machine having weight plates and a weight pin, with members of a measurement system according to an embodiment.
FIG. 2B is a cross-sectional side view of the parts shown in FIG. 1A.
FIG. 2C illustrates the parts of FIG. 2A, in operation of the exercise machine.
FIG. 2D shows an engaging member in the form of a pin, according to an embodiment.

FIGS. 2A-2D show various views of a part of an exercise machine, comprising a lifting mechanism 114 and an engaging member 110 for selectively engaging a number of stacked weights 102 to the lifting mechanism. FIGS. 2A and C illustrate perspective views, whereas FIG. B schematically illustrate a vertical cross-section through the weight stack 102, the lifting mechanism 114 and the engaging member 110. In the illustrated embodiment, the lifting mechanism includes a support member 114 having a rod-shaped portion, configured to pass vertically through corresponding holes in the weights 102. The support member 114 may furthermore include a top portion, such as a fixed top weight 102. The measurement system may comprise a pair of cooperating members including a range meter 111 and a reflector member 1101. One of the cooperating members is connected to the lifting mechanism 114 and the other of the cooperating members is connected to the engaging member 110. The range meter 111 is directed to measure a distance to the reflector member 1101 to determine a distance which correlates to the weight of the selectively engaged weights. In the illustrated embodiments, the range meter 111 is fixed to the lifting mechanism 114 and the reflector member 1101 is connected to the engaging member 110. The following description will be directed to this type of embodiment, but as will be readily understood by the skilled reader, the opposite arrangement may be employed in various embodiments, i.e. with the range meter connected to the engaging member 110 and the reflector member being connected to the lifting mechanism 114.

Figure 2B:
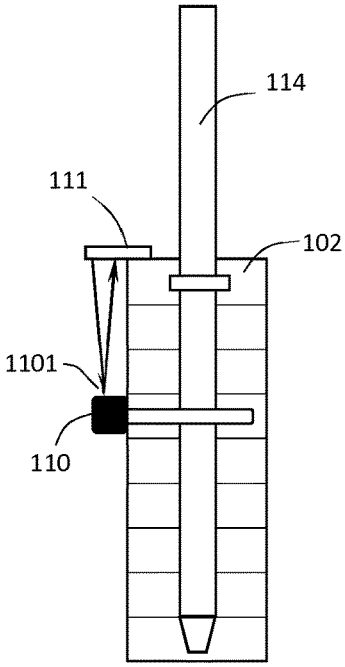
Figure 2C:
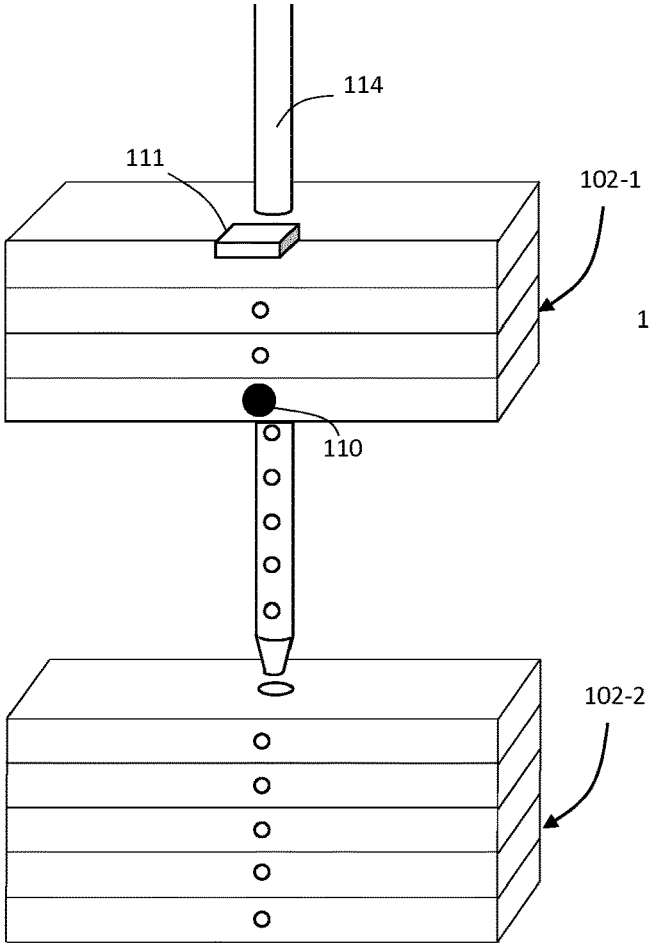
Figure 2D:
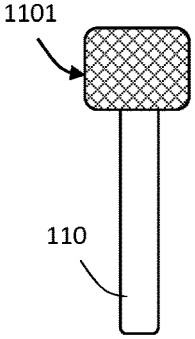

FIG. 2D schematically illustrates an engaging member 110 in the form of a weight pin, having a handle or knob to which the reflector member 1101 is connected. In one embodiment, the reflector member 1101 may be a reflective surface 1101, such as a reflective tape attached about a perimeter of the handle. In an alternative embodiment, the reflector member may comprise a paint or surface structure, configured to be diffusively reflective to electromagnetic radiation of at least the wavelength range within which a range meter 111 operates. In other embodiments, a surface of the handle may comprise dimples or other surface shapes, so as to provide a suitable reflectivity to ultrasound emitted by the range meter 111.

As can be seen in FIGS. 2A-2C, the range meter 111 is preferably connected to the lifting mechanism 114 vertically above the weight stack 102, and directed to carry out distance measurement downwards towards the engaging member 110. Different embodiments may include different types of range meters 111. In various embodiments, the range meter 111 operates by emitting a signal towards the reflector member, and detecting a reflection of the emitted signal. The range meter 111 is preferably configured to carry out signal processing to determine the distance to the point of reflection, based on at least the detected received signal.

Figure 3:
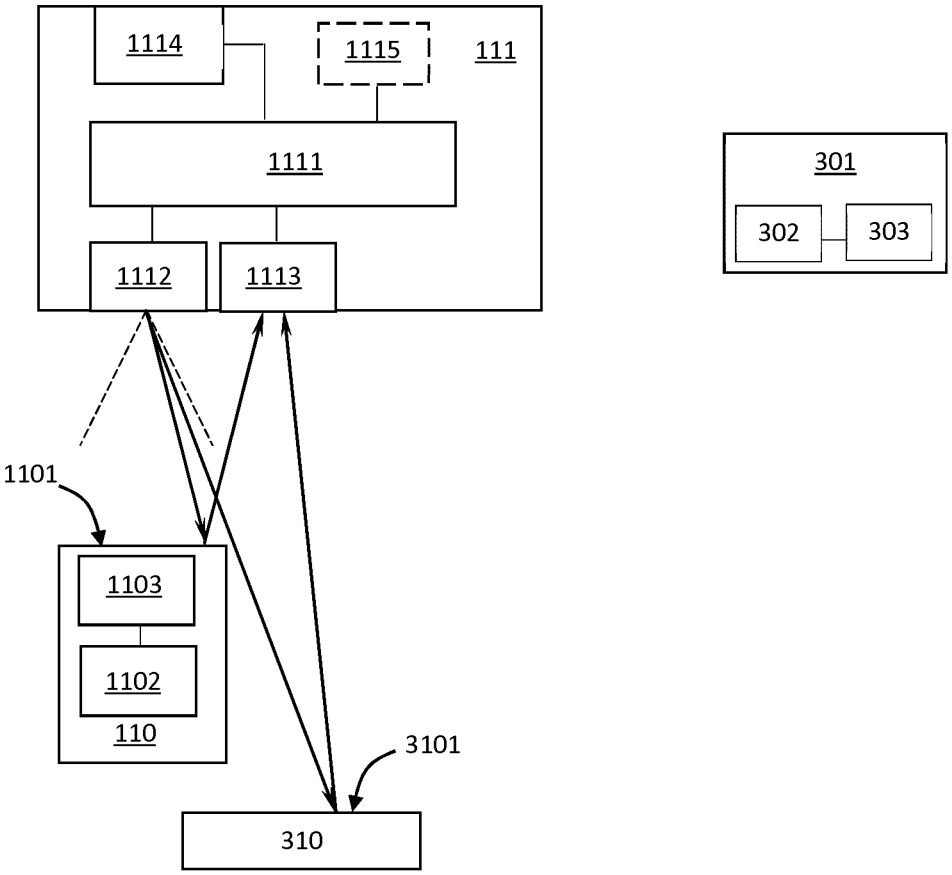
FIG. 3 is a schematic diagram of exemplary circuitry that may be employed in various embodiments of the proposed measurement system of the present disclosure.

FIG. 3 schematically illustrates a range meter 111 and its cooperating reflector member 1101. In one embodiment, the range meter 111 comprises a time of flight sensor. The range meter 111 may include an electromagnetic transmitter 1112, configured to emit an electromagnetic signal wave within angle, e.g. a cone angle, as indicated by the dashed lines. Upon reflection at reflector member 1101, at least a portion of the emitted signal is directed back towards the range meter 111, where it is sensed in a detector 1113. The detector 1113 is preferably configured with a field of view corresponding to the emission angle of the transmitter 1112. A control unit 1111 preferably includes a measurement circuit configured to measure distance to the point of reflection dependent on the emitted signal and the reflected signal. In one embodiment, the range meter 111 may be time of flight sensor, where the emitter 1112 is a light emitter configured to emit a periodic signal, e.g. a near infrared (NIR) signal. Such a time of flight sensor may e.g. operate according to the principles disclosed in US2016/0047904, providing a method for measuring a distance by measuring phase of a series of bursts of pulses relative to a periodic generator signal, the content of this document being incorporated herein by reference. In an alternative embodiment, the range meter 111 comprises a radar. In yet another embodiment, the range meter may be configured to measure distance by emitting and detecting ultrasound, as such comprising an ultrasound transmitter 1112 and an ultrasound receiver 1113.

Returning to the embodiments of FIGS. 2A-2C, the range meter 111 is preferably placed on top of the weight plates 102, e.g. connected thereto by means of screws, an adhesive, clamps, magnet or other fastening means. The range meter 111 may be fastened to the rod portion, to the uppermost weight, or other part of the lifting mechanism 114. The range meter, e.g. a time of flight sensor 111, is configured to measure the distance to the pin 110, more particularly to the reflector member 1101 on the pin 110. A benefit of using a time of flight sensor is the small packaging and high precision in available products, such as e.g. the VL53L0 from STMicroelectronics. In addition, by placing the range meter immediately on top of the weight stack 102, and measuring the comparatively short distance to the engaging member 110, the maximum distance will in most gym machines never exceed 1 meter, or even a maximum distance of 50 cm. This makes it possible to employ range meters adapted for measurement of comparatively short distances, thereby minimising power consumption. Furthermore, since the range meter is placed vertically over the reflector member 1101, movement of the engaging member 110 to select a different weight setting will still entail displacement of the reflector member along the line of sight of the range meter. By fixedly attaching the range meter to the lifting mechanism, movement of the engaging member 110 will not lead to any change in position or direction of the emitter and receiver field of view. This means that a more reliable and less complex system can be obtained, than with a system employing an active sender or received in the movable weight pin 110, especially since most weight pins are freely rotatable.

In various embodiments, an operation detection mechanism is communicatively connected to trigger the range meter 111 to make a distance measurement responsive to detection of operation of the exercise machine 101. In the embodiment of FIG. 3, the operation detection mechanism is configured as a unit 301. The operation detection mechanism 301 may comprise a motion sensor 302 connected to sense movement of the lifting mechanism, and a control unit 303 communicatively connected to the range meter 111. In the embodiment indicated in FIG. 3, the operation detection mechanism 301 is configured as a separate unit. The control unit 303 of a separate unit 301 may wire-bound to control unit 1111. In an alternative embodiment, the physically separate operation detection mechanism 301 is wirelessly connected to the range meter 111. In such an embodiment, the control unit 303 may comprise a radio or optical transmitter, for communication with a receiver 1114 in the range meter unit 111. In yet another embodiment, the operation detection mechanism 301 is wirelessly connected to another node (not shown), which in turn is wirelessly connected to transmit a trigger signal to the range meter 111. In one embodiment, the control unit 303 includes a Bluetooth Low Energy (BLE) transmitter, providing a wireless personal area network with reduced power consumption compared to classic BT.

In an alternative embodiment, a motion sensor 1115 may be integrated with the range meter 111, and the control unit for the motion sensor 1115 may form part of the control unit 1111.

In one embodiment, the motion sensor 302 may be configured to repeatedly transmit a sensed motion signal to the range meter 111, wherein the range meter 111 may determine whether a received motion signal is of such character, such as magnitude, acceleration or time, that a distance measurement is triggered. In an alternative embodiment, the control unit 303 may be configured to carry out a comparison between a motion signal from the motion detector 302 and a threshold value, and to transmit a trigger signal to the range meter 111 to make a distance measurement only when the threshold value is exceeded. Such an embodiment will entail less transmission, where the operation detection mechanism is configured as a separate unit 301.

In one embodiment, the operation detection mechanism may include an accelerometer 302 (or 1115), and the control unit 303 (or 1111) may comprise a CPU including a memory, such as a non-transitory memory, holding computer program code for comparing a motion signal from the accelerometer 302 to a threshold. The control unit 302 may further comprise a BLE transmitter and a battery (not shown).

In a preferred embodiment, the motion sensor 302 of the operation detection mechanism 301 is connected to a member of the lifting mechanism configured to make a non-linear motion upon operation of the exercise machine. In FIG. 1, this is schematically illustrated by means of the unit 301 being attached to a lever of the movable exercise bar 108. When that type of machine is operated, the lever will rotate about its suspension axis visible just below the unit 301. Consequently, the operation detection mechanism 301, with its motion detector 302, will be subjected to a rotational movement. Where the motion detector includes an accelerometer 302, rotation thereof about a non-vertical rotation axis will be detected as a variation or change of the otherwise sensed gravity acceleration. So, rather than having to rely on the actual acceleration having to de detected, e.g. for a vertical linear movement, a delta value which is substantially independent of the actual speed and acceleration of the movement can be detected. This is a clear benefit, since the actual linear movement of the weight stack upon operation of the machine by a user may be very smooth and consequently carried out with very small linear acceleration. It may be noted that location of the operation detection mechanism 301 shown in FIG. 1 is merely exemplary. It may e.g. be located on other parts of the pivotable exercise bar 108, or connected to the upper or lower wheel for guiding the cable 112. A unit 301 comprising an accelerometer 302, a chip 303 with a CPU connected to a BLE, and a battery, can be provided in a very small package that easily may be attached to any part of the exercise machine without inhibiting proper operation of the gym machine. The unit 301 may be attached by e.g. screws, a magnet, an adhesive or the like.

In a preferred embodiment, an operation detection mechanism 301 comprising an accelerometer attached to the gym machine to sense rotation about a non-vertical rotation axis is configured such that a number of weight lifting repetitions is calculated by the control unit 303. Preferably, logic is applied which separates different sets of exercise, by means of time measurement. As an example, if no acceleration change is detected for a predetermined amount of time, e.g. 5 or 10 seconds, a set of repetitions is deemed to have ended, whereas repetitions made with shorter interruptions are deemed to belong to a common set. This logic may e.g. be applied by control unit 303, or by control unit 1111 after transmission of accelerometer data to the range meter 110.

In one embodiment, the motion sensor may be comprised in the engaging member 110, configured to detect movement or placement of the engaging member with respect to the stack of weights 102 for detecting operation of the exercise machine. The operation detection mechanism may further include a control unit 1103, e.g. including a CPU and a BLE transmitter, corresponding to the description of unit 301. Even if movement of the engaging member may be slow, i.e. with low acceleration, the entering of the engaging member in the form of a weight pin 110 until it reaches a mechanical stop at the weight stack 102, will provide a spike signal in the accelerometer that is easily detectable. In another variant of the measurement system, the operation detection mechanism comprises a proximity sensor 1102 connected to the engaging member 110, configured to detect movement or placement of the engaging member with respect to the stack of weights 102 for detecting operation of the exercise machine. As an example, the proximity sensor 1102 may comprise a magnetometer for detecting that the engaging member 110 is inserted in the weight stack 102, by generating a signal which is dependent on the proximity of the magnetic metal weight stack. In another example, proper attachment of the engaging member 110 in the weight stack may cause or change an electric character as detected by the proximity sensor 1102, e.g. a shortcut.

The control unit 1103 may be configured to determine whether a detected motion or proximity signal represents actual operation of the weight machine, in this case the engaging member 110, e.g. by means of a threshold comparison, and to signal the range meter 111 to trigger it to make a distance measurement. In a preferred embodiment, the operation detection mechanism is configured to trigger the optical range meter to make a single distance measurement for an exercise sequence comprising any number of lifting repetitions without alteration of weight. As an example, when it is detected, by means of sensed motion or proximity of the engaging member 110, that it has been moved, the range meter 111 is triggered to make a single time of flight measurement. In one embodiment, a predetermined delay may be employed between detection of operation of the engaging member 110, and carrying out the distance measurement by means of the range meter 111, for the purpose of minimising the risk of a user's hand disturbing the line of sight between the range meter 111 and the reflector 1101. Such a delay may be short, e.g. 2-5 seconds, or longer. In an alternative embodiment, detection of use of the exercise machine by an accelerometer devised to sense rotation about a non-vertical axis, such as unit 301 in FIG. 1, may be used a trigger for executing the range measurement. Normally, when operation of the machine has commenced, there is very little risk that the user obstructs the mentioned line of sight.

So, in one embodiment of a measurement system, operation of the engaging member 110 is sensed by a first motion detector 1102, movement of the weight stack 102 is sensed by the same motion detector 1102 or by a second motion detector 302, wherein the range meter 111 is configured to carry out a distance measurement dependent on detection on movement of the engaging member 110. The range meter may be triggered by detection of movement of the engaging member 110 to measure the distance to it. Logic in the control unit 1111 may cause the range meter 111 to obtain a distance measurement if movement of the engaging member 110 has been detected since a last distance measurement. The control unit 1111 may thus comprise a memory for storing at least a latest detected distance and/or corresponding weight setting.

In one embodiment, the distance measurement is carried out dependent on detection of movement of the weight stack 102. More particularly, the range meter may be configured to carry out a new distance measurement at a point in time triggered by detection of movement of the weight stack 102, as reported by a motion detector 302, 1102 or 1115. As an alternative, the range meter may be configured to carry out a new distance measurement at a point in time triggered by detection of operation of the engaging member 110, as reported by a motion detector or proximity detector 1102. By means of these measures for triggering a single distance measurement upon detecting operation of the engaging member 110, use of the range meter is minimised, which may be a crucial object so as to minimise power consumption in a deployed battery-charged measurement system.

According to one aspect, a measurement system is provided for use in an exercise machine, which exercise machine comprises a lifting mechanism and an engaging member for selectively engaging a number of stacked weights to the lifting mechanism. The measurement system comprises an operation detection mechanism, such as unit 301, including an accelerometer 302, which is connected to a member of the lifting mechanism so as to sense rotational movement about a non-vertical axis upon operation of the exercise machine. Detected movement may e.g. be used to trigger a distance measurement or other means for determining weight, such as obtaining a picture of the attached weights, sensing an NFC tag of the attached weights, or other. Detected movement may also be used for calculating and reporting a number of repetitions, the time characteristics of the exercise etc, e.g. by means of a control unit 303 attached to the accelerometer 302, and preferably also configured to transmit collected and/or calculated data to a remote received, e.g. as an observer station 120 or a server 122. In this broader sense, the measurement system may be used in an exercise machine such as the one in FIG. 1, configured for lifting a selectable number of stacked weights, where the engaging member may be a pin. This type of measurement system may be used also with other types of machines, though, e.g. having engaging members in the form of bar-like protrusions, on which free weights may be suspended.

Returning to FIG. 3, an alternative embodiment is indicated having an auxiliary reflector member 3101 attached to a fixed position 310 with respect to the gym machine, such as to the floor or a lower fixed member of the machine. Preferably the auxiliary reflector member 3101 is positioned such that reflection in the reflector member 1101 and in the auxiliary reflector member 3101, are both sensed in the detector 1113 after a single signal transmission from the emitter 1112. The range meter 111 may be directed to measure a distance to the auxiliary reflector member, and to use variations of the measured distance to detect movement of the lifting mechanism, as an alternative or complement to the use of an accelerometer 302, 1115 or 1102.

Preferably, the range meter 111 is held in sleep mode until the motion sensor or sensors detect absolution motion, i.e. by when movement of the engaging member 110 is sensed by sensed motion or proximity sensor 1102, when movement of the weight stack is sensed by accelerometer 302 or 1102, or when both criteria are fulfilled as outlined above. The measured distance to the reflector 1101 on the engaging member 110 is converted into a weight measurement, e.g. in a server at the gym or in the cloud, or locally in the range meter control unit 111. Sensed acceleration (or distance to the auxiliary reflector member 3101) is then used to count number of repetitions. The operation detection mechanism may also count the time for each repetition and the time for when the motion turns and goes back, e.g. by means of motion detector 302 or 1102, since such data may also be of value for the user and a personal trainer. Data, such as weight, repetitions, time etc., as detected and measured, may be provided to the user on a display 117 attached to the exercise machine or at a separate observer station 120. The observer station 120 may communicate the information received from the weight pin 110 to a server 122 or a network account held by the user, via the internet 124 or via a wired connection (not shown), where the data can be stored on the server 122 for further processing. Alternatively, or in addition, such exercise data may be downloaded into a device carried by the user, e.g. addressed using data obtained by communication with the identification tag 130 of the user, e.g. by means of NFC, Bluetooth® connection or similar.

The embodiments described above relate to calculation of lifted weight of a selected number of weights 102 in a stack. In various types of exercise machines, extra weights may also be added, so as to set a weight value between two standard weight stack selections. Various solutions for such a measurement system applicable to such a machine will now be described with reference to FIGS. 4A-C.

Figure 4A:
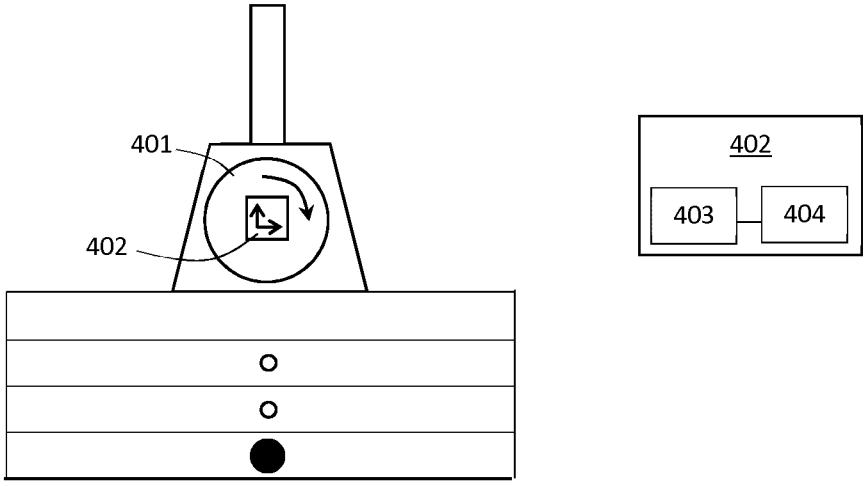
FIGS. 4A-C illustrate various embodiments of measurement systems applied in alternative weight machine configurations.

FIG. 4A illustrates a part of a weight-lifting exercise machine, such as the one of FIG. 1 and described extensively above. In addition, a movable auxiliary selector member 401 is provided on the exercise machine, for engaging an additional amount of weight to the lifting mechanism. For instance, where each weight 102 of the stack weighs 10 kg, the auxiliary selector member 401 may be rotatably set to add 2.5, 5 or 7.5 kg, so as to obtain a finer setting. An auxiliary sensor 402 may be included to detect a position of the movable auxiliary selector member 401.

As seen in the embodiment of FIG. 4A, the auxiliary sensor 402 may include a rotation sensor mechanism connected to detect angular position of the rotatable selector member. As an example, the auxiliary sensor 402 may comprise an accelerometer 403 configured to detect change of sensed gravitation, as also explained with reference to unit 301.

Figure 4B:
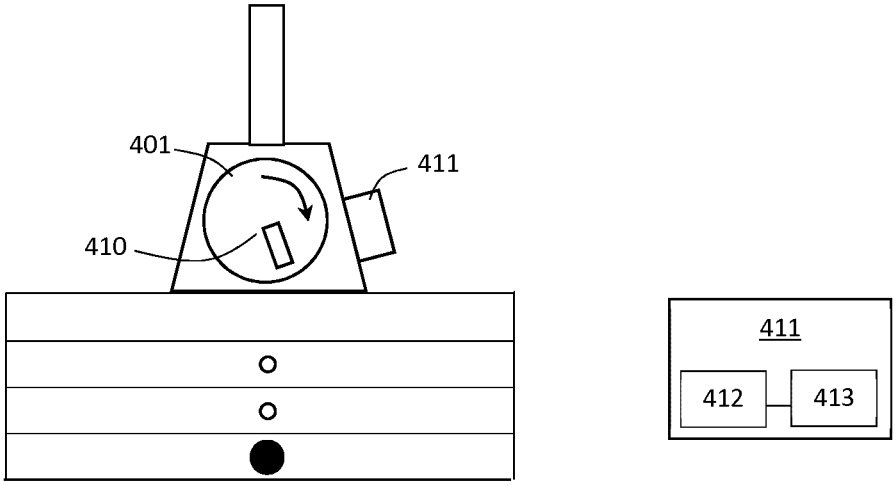

In the alternative embodiment of FIG. 4B, the auxiliary sensor 402 may include a proximity sensor 411 connected to sense proximity of a detection element 410 connected to the auxiliary selector member. The proximity sensor 411 may e.g. be a magnetometer, wherein the detection element 410 may be a magnetic member having a certain polarity. The magnetometer 411 may sense proximity to the detection member 410 by means of detected magnetic field strength, and also field direction as dependent on the direction between the detection element 410 and the magnetometer 411 in different angular positions of the auxiliary selector member 401. This data may be composed to gather the angular position, and hence the set weight, of the auxiliary selector member 401.

Figure 4C:
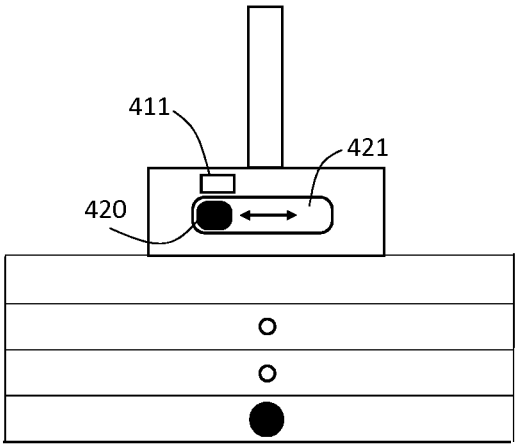

FIG. 4C illustrates yet another embodiment, forming part of a weight-lifting exercise machine, such as the one of FIG. 1. In this case, the movable auxiliary selector member includes a handle or lever 420, slidable along a path 421 between two or more positions so as to set an additional amount of weight to the lifting mechanism. An auxiliary sensor may include a proximity sensor 411 connected to sense proximity of a detection element included in the movable handle 420. The proximity sensor 411 may e.g. be a magnetometer, wherein the detection element 420 may be a magnetic member in the handle. The magnetometer 411 may sense proximity to the detection member by means of detected magnetic field strength.

In anyone of the embodiments of FIGS. 4A-C, the sensor 402 or 411 preferably also includes a control unit 404/413 comprising a transmitter, such as BLE, for communicating with a central unit such as the range meter 111, observer station 120 or other, in accordance with the preceding description.

According to one aspect, a measurement system e.g. according to the principles of FIG. 4A or B may be employed in an exercise machine, which exercise machine comprises a lifting mechanism and a rotatable selector member for selectively engaging a number of weights to the lifting mechanism, wherein the range meter solution as previously discussed is optional. Such a measurement system may comprise a rotation detector 402 or 411 connected to the rotatable selector member 401, wherein the rotation detector is configured to determine angular position of the rotatable selector member which correlates to the weight of the selectively engaged weights.

An overall benefit of the proposed measurement system is that it is easy to install, also in an already deployed gym environment. A system based on e.g. a time of flight meter is very robust, and particularly where configured to be awaken from sleep mode by a motion detector, such as an accelerometer, it drains very little power and devices required to build the system carry low cost.

The invention claimed is:

1. A measurement system for use in an exercise machine, which exercise machine comprises a lifting mechanism and an engaging member for selectively engaging a number of stacked weights to the lifting mechanism such that the engaging member moves jointly with the lifting mechanism, the measurement system comprising a pair of cooperating members including a range meter and a reflector member, wherein one of the cooperating members is connected to the lifting mechanism and the other of the cooperating members is connected to the engaging member, wherein the range meter is directed to measure a distance to the reflector member to determine a distance which correlates to the weight of the selectively engaged weights.

2. The measurement system according to claim 1, wherein the range meter is connected to the lifting mechanism and the reflector member is connected to the engaging member.

3. The measurement system according to claim 1, comprising an operation detection mechanism communicatively connected to trigger the range meter to make a distance measurement responsive to detection of operation of the exercise machine.

4. The measurement system of claim 3, wherein the operation detection mechanism comprises a motion sensor connected to sense movement of the lifting mechanism.

5. The measurement system of claim 4, wherein the motion sensor mechanism is wirelessly connected to the range meter.

6. The measurement system of claim 4, wherein the motion sensor is connected to a member of the lifting mechanism so as to sense rotational movement about a non-vertical axis upon operation of the exercise machine.

7. The measurement system of claim 3, wherein the operation detection mechanism comprises a motion sensor connected to the engaging member, configured to detect movement or placement of the engaging member with respect to the stack of weights for detecting operation of the exercise machine.

8. The measurement system of claim 3, wherein the operation detection mechanism comprises a proximity sensor connected to the engaging member, configured to detect movement or placement of the engaging member with respect to the stack of weights for detecting operation of the exercise machine.

9. The measurement system of claim 8, wherein the proximity sensor comprises a magnetometer for detecting that the engaging member is inserted in the weight stack.

10. The measurement system of claim 3, wherein the operation detection mechanism is configured to trigger the optical range meter to make a single distance measurement for an exercise sequence comprising any number of lifting repetitions without alteration of weight.

11. The measurement system of claim 1, comprising an auxiliary sensor to detect a position of a movable auxiliary selector member of the exercise machine, which auxiliary selector member is configured to engage an additional amount of weight to the lifting mechanism.

12. The measurement system of claim 11, wherein the auxiliary sensor comprises a proximity sensor connected to sense proximity of detection element connected to the auxiliary selector member.

13. The measurement system of claim 11, wherein the auxiliary selector member comprises a rotatable selector member and the auxiliary sensor includes a rotation sensor mechanism connected to detect angular position of the rotatable selector member.

14. The measurement system of claim 1, wherein the range meter comprises a time of flight sensor.

15. The measurement system of claim 14, wherein the time of flight sensor comprises a light emitter configured to emit a periodic signal, a light detector, and a measurement circuit configured to measure distance dependent on an emitted signal and a reflected signal received by the detector.

* * * * *